US007435138B2

(12) United States Patent
Liu et al.

(10) Patent No.: US 7,435,138 B2
(45) Date of Patent: Oct. 14, 2008

(54) ELECTRICAL CONNECTOR WITH IMPROVED SHIELDING MEMBER

(75) Inventors: Yan-Sheng Liu, Kunshan (CN); Ren-Chih Li, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/703,355

(22) Filed: Feb. 7, 2007

(65) Prior Publication Data

US 2007/0243764 A1 Oct. 18, 2007

(30) Foreign Application Priority Data

Apr. 13, 2006 (CN) ..... 2006 2 0072594 U

(51) Int. Cl.
*H01R 13/648* (2006.01)

(52) U.S. Cl. ..... 439/607; 439/680; 439/59

(58) Field of Classification Search ..... 439/607, 439/59, 680
See application file for complete search history.

(56) References Cited

U.S. PATENT DOCUMENTS

| | | | | | |
|---|---|---|---|---|---|
| 5,685,739 | A * | 11/1997 | Davis et al. | ..... | 439/607 |
| D452,680 | S * | 1/2002 | Kubota | ..... | D13/147 |
| D488,447 | S | 4/2004 | Kuroki | | |
| 6,767,251 | B2 * | 7/2004 | Yu et al. | ..... | 439/607 |
| 2005/0095913 | A1 * | 5/2005 | Fan | ..... | 439/607 |

* cited by examiner

*Primary Examiner*—Renee S Luebke
*Assistant Examiner*—Harshad C Patel
(74) *Attorney, Agent, or Firm*—Wei Te Chung

(57) ABSTRACT

An electrical connector comprises an insulated housing (1) having a base (10) a plurality of conductive terminals (2) retained in the housing and a shielding member (3) assembled on the housing. The base extends along a longitudinal direction and defines a latching hole (16) recessed at one of lengthwise ends of thereof. The shielding member has a latching portion (34) extending along a mating direction of the electrical connector perpendicular to the longitudinal direction so as to be retained in said latching hole.

6 Claims, 5 Drawing Sheets

ELECTRICAL CONNECTOR WITH IMPROVED SHIELDING MEMBER

BACKGROUND OF THE INVENTION

1. Field of the Invention

The present invention is generally related to the art of electrical connectors, and more particularly, to an electrical connector used for connecting electronic devices.

2. Description of Related Art

A variety of electrical connectors are widely used for transmitting signals between electronic devices or electronic components of the electronic devices. U.S. Pat. No. D488,447 discloses a conventional electrical connector with a shielding member. The connector is usually used on a peripheral device for mating with a complementary connector generally provided on Personal Digital Assistant (PDA) or the like electronic devices. The connector includes an insulated housing with a substantially rectangular shape, a plurality of conductive terminals arranged in the housing and a shielding member assembled on an outer of the housing for preventing the Electro-Magnetic Interference (EMI). The housing has a base extending along a longitudinal direction and a mating portion extending forward from the base. The shielding member has a pair of latching portions which extend opposite to each other along said longitudinal direction of the base. The latching portions are bent into and retained in corresponding lengthwise ends of the base. For the connector can be firmly mounted on a printed circuit board, the connector further comprises a pair of locking member mounted on lengthwise ends of the housing.

It is noted that the shielding member is constructed by stamping from a single metal plate. The latching portions disclosed above extend along the longitudinal direction so that the width of the shielding member is enlarged. A metal plate with larger area is required to produce the shielding member, and thus the produce cost is accordingly increased. Therefore, a new electrical connector is desired to overcome the disadvantage of the prior art connector.

SUMMARY OF THE INVENTION

Accordingly, an object of the present invention is to provide an electrical connector, which can decrease the product cost.

In order to achieve the object set forth, an electrical connector is provided. The electrical connector comprises an insulated housing having a base extending along a longitudinal direction, the base defining a latching hole thereon; a plurality of conductive terminals retained in the housing; and a shielding member assembled on the housing and having a latching portion extending along a mating direction of the electrical connector perpendicular to the longitudinal direction so as to be retained in said latching hole.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
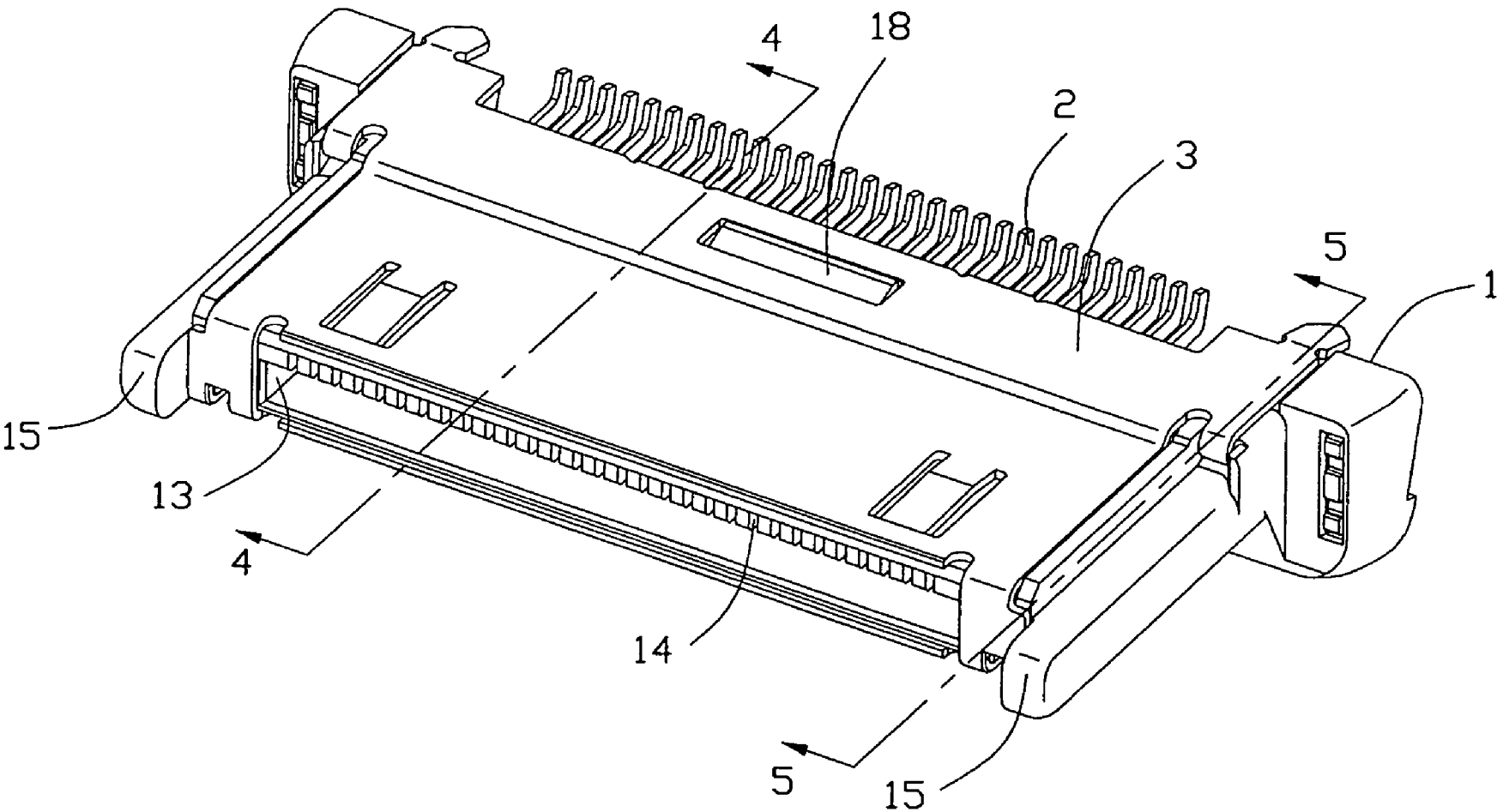
FIG. 1 is an assembled, perspective view of an electrical connector in accordance with the present invention.
Figure 3:
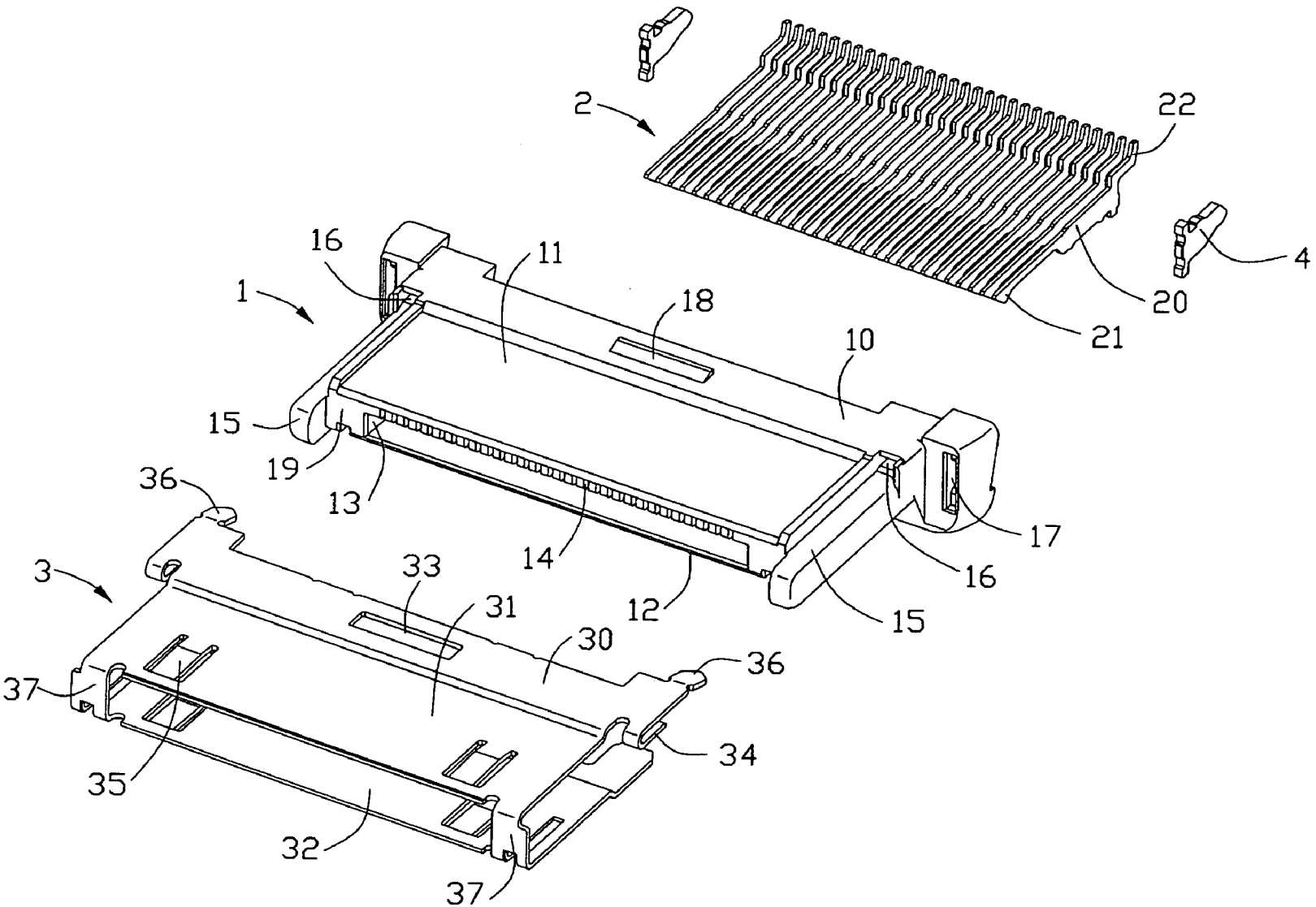
FIG. 3 is an exploded, perspective view of the electrical connector.

Referring to FIGS. 1 and 3, an electrical connector in accordance with the present invention is provided. The electrical connector comprises a insulated housing 1 with a substantially rectangular shape, a plurality of conductive terminals 2 located in the housing 2, a shielding member 3 mounted to and encircling the housing 2 and a pair of locking members for connecting with a printed circuit board where the electrical connector is mounted.

Figure 2:
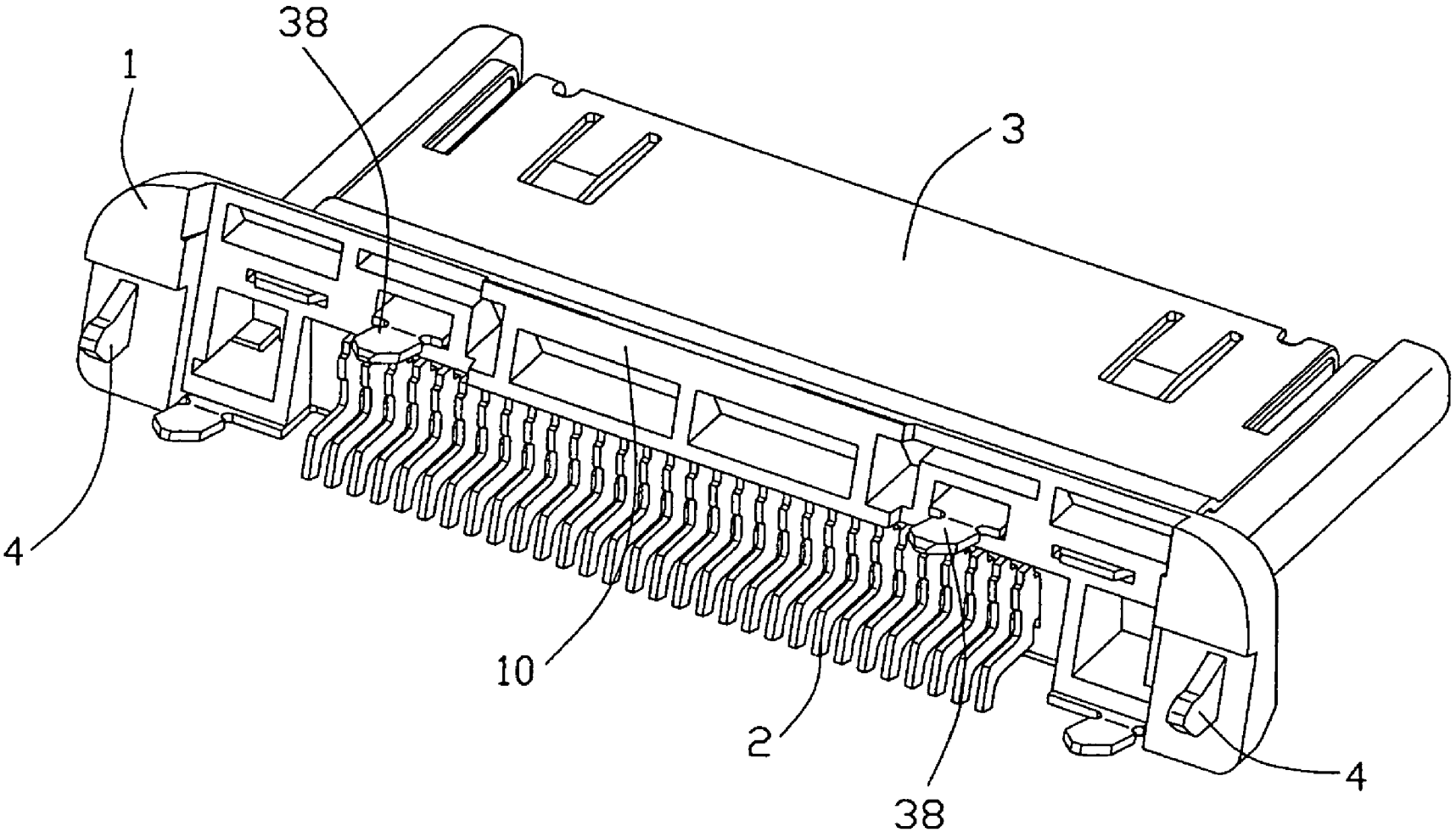
FIG. 2 is a similar view of FIG. 1, but taken from another aspect.

Referring to FIGS. 1 to 3, the housing comprises a base 10 extending along a longitudinal direction and a mating portion extending forward from a front surface of the base 10 along a mating direction perpendicular to the longitudinal direction. The mating portion defines a mating surface 19 and comprises a first sidewall 11, a second sidewall 12 parallel to and spacing a distance from the sidewall 11 and a receiving cavity 13 formed between the first and second sidewalls 11, 12. The first sidewall 11 defines a plurality of terminal channels 14 communication with the receiving cavity 13 for receiving said conductive terminals 2 therein.

The housing 1 further comprises a pair of guiding portions 15 which are located beside corresponding lateral sides of the mating portion. The guiding portions 15 extend from the front surface of the base 10 along the mating direction, and beyond the mating surface 19. The base 10 defines a mounting surface at its rear end which is formed at a sharp angle to the mating direction. The base 10 comprises a pair of latching hole 16 beside the corresponding guiding portions 15 which are recessed rearward from its front surface along the mating direction; a pair of grooves 17 formed at longitudinal ends of the base 10 for receiving the locking members 4 therein; and a projection 18 extending from a middle portion of its side surface.

Figure 4:
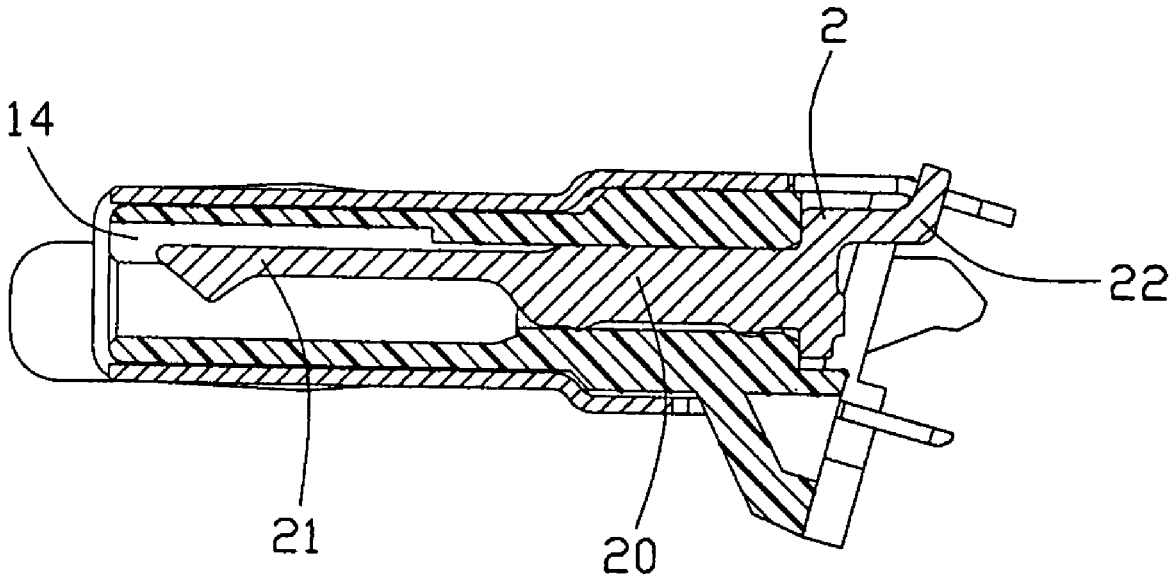
FIG. 4 is a cross-sectional view of the electrical connector, taken along the line 4-4 of FIG. 1.
Figure 5:
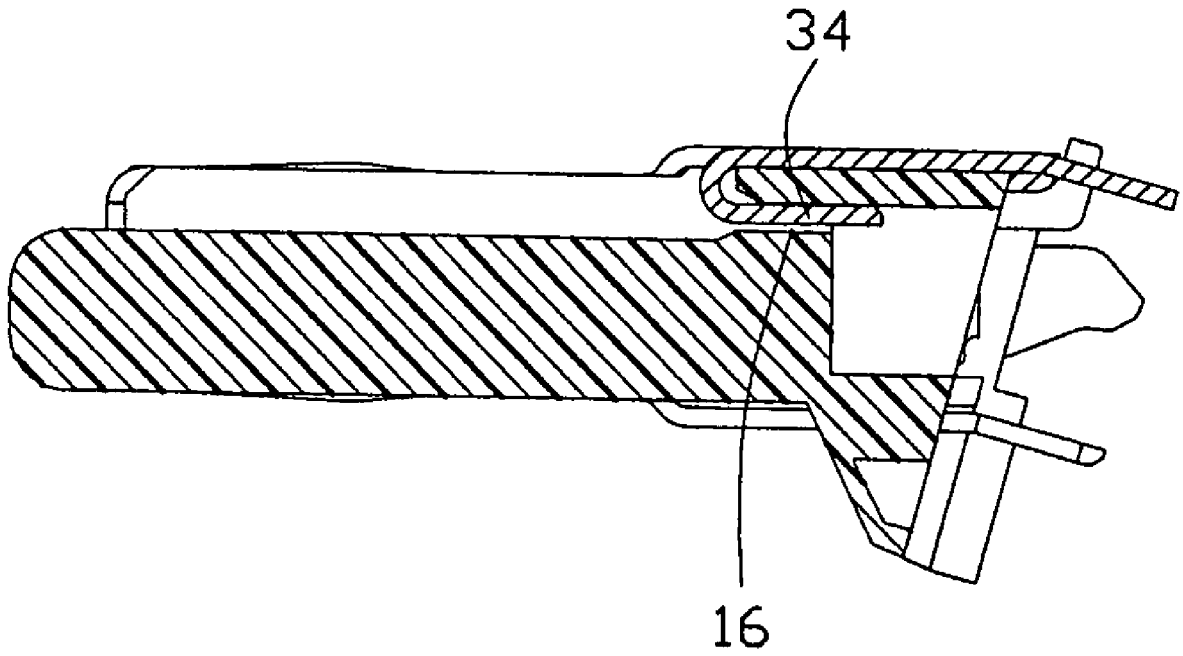
FIG. 5 is a cross-sectional view of the electrical connector, taken along the line 5-5 of FIG. 1.

Referring to FIGS. 3 and 4, when assembling, the terminals 2 are inserted into the corresponding terminals channels 14 from the rear end of the housing 1. Each terminal 2 has a retention portion 20 providing barbs for interferentially engaging with the terminal channel 14, a contact portion 21 extending forward from the retention portion 20 and exposed to the receiving cavity 13 and a solder portion 22 extending rearward from the retention portion 20 for connecting the connector to the printed circuit board.

The shielding member 3 is constructed by stamping from a single metal plate. Referring to FIGS. 1 to 3 and 5, the shielding member 3 comprises a first side plate 31 mainly covering the first sidewall 11, a second side plate 32 mainly covering the second sidewall 12 and a adjoining portion 37 abutting against the mating surface of the housing for connecting the first and second side plates 31, 32 together. The portion of the first side plate 31 used for covering the base 10 is defined as a tail plate portion 30. The tail plate portion 30 has an opening 33 for engaging with the projection 18 of the base 10, a pair of latching portions 34 respectively retained into the latching holes 16 and a pair of solder legs 36 extending perpendicular to the mounting surface of the base 10. The second side plate 32 also has a pair of solder legs 38 but with a larger distance therebetween than that of the solder legs 36 of the first side plate 31. The shielding member 3 is completely mounted on the housing 1 by the engagement between the opening 33 and the projection 18 and the combination between the latching portions 34 and the latching holes 16. The shielding member 3 further has a plurality of resilient protrusion 35 which can have the electrical connector firmly mating with a complementary connector.

Referring to FIGS. 3 and 4, the latching portions 34 extend along the mating direction, namely, parallel to the first and second side plate portions 31, 32. This configuration of the latching portions 34 minimize the width of the shielding member 3, and thus efficiently reduce the material cost of the metal plate from which the shielding member 3 is stamped.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulated housing having a base extending along a longitudinal direction and defining therein a receiving cavity and an interior latching hole located beside said receiving cavity and extending communicative upward toward an exterior;

a plurality of conductive terminals retained in the housing and extending into said receiving cavity; and a shielding member defining opposite two folded side plates linked with each other by an upper adjoining portion, said two side plates respectively covering two opposite side faces of the housing and the upper adjoining portion covering a top face of the housing, said shielding member further having a latching portion located inside of said side plates so as to be downwardly latchably inserted into said latching hole.

2. The connector as claimed in claim 1, wherein said latching portion is parallel to the corresponding side plate.

3. The connector as claimed in claim 1, wherein said shielding member further includes a mounting leg extending downwardly from a lower edge region thereof for connecting to a printed circuit board on which the connector is mounted, wherein said mounting leg and said latching portion are generally aligned with each other in a transverse direction perpendicular to said longitudinal direction.

4. The connector as claimed in claim 1, wherein said latching portion is linked to the corresponding side plate via a lower adjoining portion which is below said upper adjoining portion.

5. The connector as claimed in claim 4, wherein said lower adjoining portion and said upper adjoining portion are essentially offset from each other not only vertically but also in said longitudinal direction.

6. The electrical connector as claimed in claim 1, wherein said shielding member further includes a lower adjoining portion linking one of said side plates with said latching portion under a condition that said upper adjoining portion and said lower adjoining portion essentially parallel to each other while the upper adjoining potion is higher than said lower adjoining portion.

* * * * *